US009036788B2

(12) United States Patent
Ueda et al.

(10) Patent No.: US 9,036,788 B2
(45) Date of Patent: May 19, 2015

(54) RADIATION GENERATING APPARATUS AND RADIATION IMAGING APPARATUS

(75) Inventors: Kazuyuki Ueda, Tokyo (JP); Shuji Aoki, Yokohama (JP); Yoshihiro Yanagisawa, Fujisawa (JP); Miki Tamura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 331 days.

(21) Appl. No.: 13/486,179

(22) Filed: Jun. 1, 2012

(65) Prior Publication Data

US 2013/0016811 A1 Jan. 17, 2013

(30) Foreign Application Priority Data

Jul. 11, 2011 (JP) ..... 2011-152791

(51) Int. Cl.
*H01J 35/18* (2006.01)
*H01J 35/16* (2006.01)
(Continued)

(52) U.S. Cl.
CPC ..... *H05G 1/025* (2013.01); *H01J 35/16* (2013.01); *G21F 5/10* (2013.01); *H01J 35/18* (2013.01); *H01J 2235/186* (2013.01); *H05G 1/04* (2013.01)

(58) Field of Classification Search
CPC ..... H01J 35/18; H01J 35/16; H01J 35/02; H01J 35/00; H05G 1/025; H05G 1/02; H05G 1/00; G21F 5/10; G21F 5/12
USPC ..... 378/119, 121, 140, 141, 142, 193, 199, 378/200, 203, 210; 250/423 R, 427, 493.1, 250/496.1, 505.1, 506.1, 507.1, 522.1, 526
See application file for complete search history.

(56) References Cited

U.S. PATENT DOCUMENTS 1,992,335 A * 2/1935 Tietig ..... 378/141
2,019,602 A * 11/1935 Findlay ..... 378/202
(Continued)

FOREIGN PATENT DOCUMENTS

GB 472296 9/1937
GB 818182 8/1959
(Continued)

OTHER PUBLICATIONS

Extended European Search Report, issued Dec. 20, 2012 by the EPO in EPO counterpart application 12004525.7 (in English).
(Continued)

*Primary Examiner* — Anastasia Midkiff
(74) *Attorney, Agent, or Firm* — Fitzpatrick, Cella, Harper & Scinto

(57) ABSTRACT

In a construction having a radiation tube in an envelope filled with an insulating liquid, a radiation generating apparatus which realizes a miniaturization of the apparatus, an improvement of a withstanding voltage between the envelope and the radiation tube, and a decrease in attenuation amount of the radiation and a radiation imaging apparatus using the radiation generating apparatus are provided. The radiation generating apparatus has an envelope 12 having a first window 27 for transmitting the radiation, a radiation tube 14 enclosed in the envelope 12 and having a second window 19 for transmitting the radiation at a position in opposition to the first window 27, and an insulating liquid 13 filled between the envelope 12 and the radiation tube 14. A solid-state insulating member 28 is placed between the first window 27 and its periphery and the second window 19 and its periphery.

24 Claims, 3 Drawing Sheets

(51) Int. Cl.

| | |
|---|---|
| ***H01J 29/82*** | (2006.01) |
| ***H01J 29/86*** | (2006.01) |
| ***H01J 5/18*** | (2006.01) |
| ***H01J 5/26*** | (2006.01) |
| ***G21F 5/10*** | (2006.01) |
| ***H05G 1/02*** | (2006.01) |
| ***H05G 1/04*** | (2006.01) |

(56) References Cited

U.S. PATENT DOCUMENTS

| | | | | |
|---|---|---|---|---|
| 2,121,630 | A | 6/1938 | Gross et al. | |
| 2,548,489 | A * | 4/1951 | Morrison | 378/197 |
| 4,384,360 | A * | 5/1983 | Kitadate et al. | 378/202 |
| 5,949,849 | A * | 9/1999 | Hirano et al. | 378/121 |
| 6,594,341 | B1 * | 7/2003 | Lu et al. | 378/140 |
| 7,428,298 | B2 | 9/2008 | Bard et al. | 378/138 |
| 2009/0010393 | A1 | 1/2009 | Klinkowstein et al. | 378/140 |
| 2011/0235783 | A1 | 9/2011 | Ogura et al. | |
| 2011/0317818 | A1 * | 12/2011 | Hertz et al. | 378/140 |
| 2012/0121069 | A1 | 5/2012 | Aoki et al. | |
| 2012/0307974 | A1 | 12/2012 | Yamazaki et al. | |
| 2012/0307978 | A1 | 12/2012 | Yamazaki et al. | |
| 2013/0016810 | A1 * | 1/2013 | Tamura et al. | 378/62 |
| 2013/0016812 | A1 * | 1/2013 | Yanagisawa et al. | 378/62 |
| 2013/0034207 | A1 * | 2/2013 | Aoki et al. | 378/62 |

FOREIGN PATENT DOCUMENTS

| | | |
|---|---|---|
| GB | 1567956 | 5/1980 |
| JP | S61-066399 | 4/1986 |
| JP | 09-045493 | 2/1997 |
| JP | 2007-080568 | 3/2007 |
| JP | 2007-250328 | 9/2007 |
| JP | 2008-535183 | 8/2008 |
| JP | 2010-257902 | 11/2010 |

OTHER PUBLICATIONS

Jpo Office Action that issued on Feb. 3, 2015, in counterpart Japanese patent application 2011-152791 (with partial translation).

* cited by examiner

RADIATION GENERATING APPARATUS AND RADIATION IMAGING APPARATUS

BACKGROUND OF THE INVENTION

1. Field of the Invention

The present invention relates to a radiation generating apparatus having a radiation tube in an envelope filled with an insulating liquid and to a radiation imaging apparatus using the radiation generating apparatus.

2. Description of the Related Art

A radiation generating apparatus in which an electron source and a target are placed in a radiation tube and an electron emitted from the electron source is irradiated to the target, thereby generating a radiation has been known.

In order to generate a radiation suitable for radiation imaging, it is necessary that a high voltage of 40 to 150 kV is applied between the electron source and the target and an electron flux is accelerated to high energy and irradiated to the target. Thus, a high potential difference of tens of kV or more is caused between the electron source and the target and between the radiation tube and the envelope enclosing the radiation tube. Therefore, in order to stably generate the radiation for a long time, it is required that the radiation generating apparatus has withstanding voltage performance (voltage proof performance) at such a high voltage.

The Official Gazette of Japanese Patent Application Laid-Open No. S61-066399 discloses a rotary anode X-ray tube apparatus in which a cooling insulating oil is filled between a rotary anode X-ray tube and an inner wall of an envelope, thereby assuring the voltage proof performance. By allowing the cooling insulating oil to smoothly flow between the rotary anode X-ray tube and the envelope, a sludge which is deposited onto the surface of the rotary anode X-ray tube is prevented, thereby reducing a discharge between the rotary anode X-ray tube and the envelope.

However, according to the related art, there is a case where a discharge occurs between the rotary anode X-ray tube and the envelope through an outflow inlet for allowing the cooling insulating oil to flow and an X-ray emitting port of the rotary anode X-ray tube. There is also such a problem that if the X-ray tube is damaged by the discharge, the X-ray cannot be stably generated for a long time.

As a measure for solving such a problem, a method whereby a layer of the cooling insulating oil between the rotary anode X-ray tube and the inner wall of the envelope is sufficiently thickened is considered. However, the withstanding voltage performance of the insulating liquid such as a cooling insulating oil or the like is more influenced by an electrode shape, an electrode surface smoothness, a temperature, impurities, convection, or the like as compared with that of another insulating member. Therefore, a thickness of the layer of the cooling insulating oil between the rotary anode X-ray tube whose temperature becomes a high temperature of 200° C. or higher during the driving and the inner wall of the envelope has to be set to a thickness enough to avoid the discharge. Thus, the envelope increases in size and a size and a weight of the whole X-ray generating apparatus increase. When the cooling insulating oil layer is thickened, an attenuation amount of the X-ray at the time when the X-ray passes through the cooling insulating oil layer increases. A higher voltage, a larger current, and the driving for a longer time are necessary in order to compensate such an attenuation amount, so that it causes an increase in electric power consumption.

The foregoing problem is not limited to the reflection type radiation generating apparatus but there is also a similar problem in a transmitting type radiation generating apparatus.

Therefore, in both of the reflection type and the transmitting type, it is required that a distance between the radiation tube and the envelope is shortened as much as possible to thereby miniaturize the apparatus, such a withstanding voltage as to make it difficult to cause a discharge between the radiation tube and the envelope is assured, and the attenuation amount of the radiation is also decreased.

It is, therefore, an object of the invention to provide a radiation generating apparatus having a construction in which a radiation tube is provided in an envelope filed with an insulating liquid, wherein a miniaturization of the apparatus, an improvement of a withstanding voltage between the envelope and the radiation tube, and a decrease in attenuation amount of the radiation are realized and to provide a radiation imaging apparatus using the radiation generating apparatus.

SUMMARY OF THE INVENTION

According to an aspect of the invention, there is provided a radiation generating apparatus comprising: an envelope having a first window transmitting a radiation; a radiation tube being held within the envelope, and having a second window transmitting the radiation at a position in opposition to the first window; and an insulating liquid filling between the envelope and the radiation tube, wherein a solid-state insulating member is placed between the first window and the second window.

According to the invention, both of the miniaturization of the apparatus and the assurance of the voltage proof performance can be accomplished with a good balance. Since the decrease in radiation amount is also avoided owing to the miniaturization, an electric power saving can be realized. Owing to the assurance of the voltage proof performance, an output of the radiation is stabilized.

Further features of the present invention will become apparent from the following description of exemplary embodiments with reference to the attached drawings.

DESCRIPTION OF THE EMBODIMENTS

Exemplary embodiments of a radiation generating apparatus and a radiation imaging apparatus of the invention will be described hereinbelow.

First Embodiment

Figure 1A:
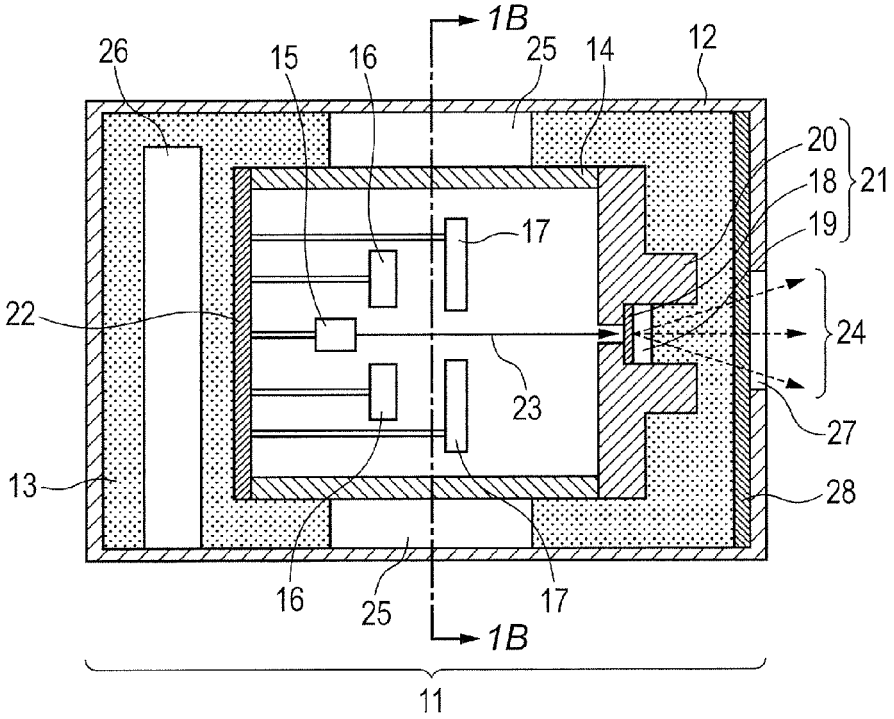
FIGS. 1A and 1B are schematic sectional views of a radiation generating apparatus of the first embodiment.
Figure 1B:
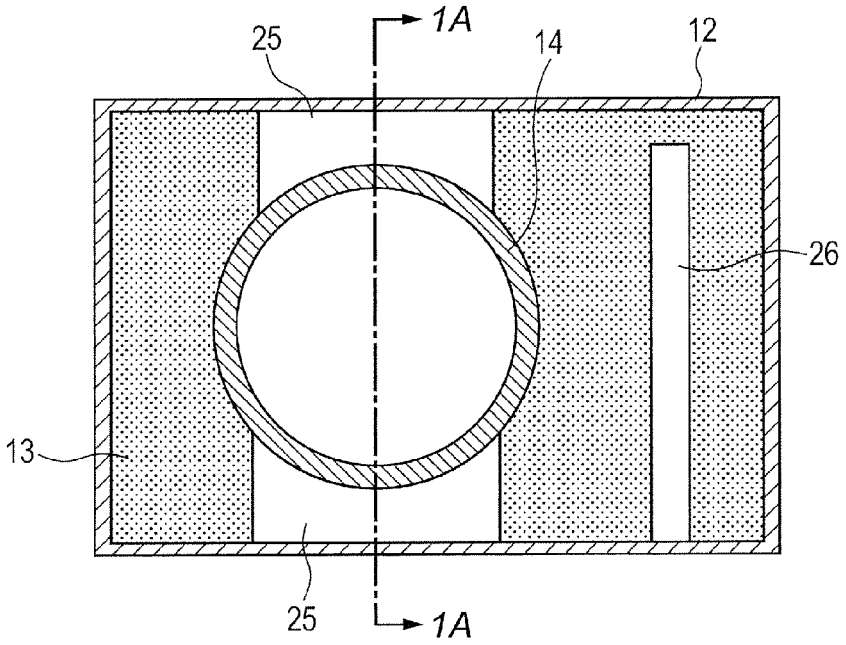

FIG. 1A shows a schematic sectional view of a radiation generating apparatus 11 of an embodiment taken along the line 1A-1A in FIG. 1B. FIG. 1B shows a schematic sectional view of the radiation generating apparatus 11 of the embodiment taken along the line 1B-1B in FIG. 1A.

The radiation generating apparatus (transmitting type radiation source) 11 of the embodiment has an envelope 12, an insulating liquid 13, a radiation tube 14, an electron source 15, a first control electrode 16, a second control electrode 17, a transmitting type target 18, a target substrate 19, and a shielding member 20. Further, the radiation generating apparatus 11 of the embodiment has a cathode portion 22, a holding member 25, a power supply circuit 26, a first window 27, and an insulating member 28.

The envelope 12 is a container for enclosing members such as a radiation tube 14 and the like. The insulating liquid 13 is filled in the envelope 12. The cylindrical radiation tube 14 whose body portion is held by the holding member 25 fixed to an inner wall of the envelope 12 is enclosed in the envelope filled with the insulating liquid 13. The insulating liquid 13 can be circulated around the radiation tube 14. A metal such as iron, stainless steel, lead, brass, copper, or the like can be used as a material of the envelope 12. An injection port (not shown) of the insulating liquid 13 is formed in a part of the envelope 12, so that the insulating liquid 13 can be injected into the envelope 12 from the injection port. In order to avoid such a situation that a pressure in the envelope 12 rises when a temperature of the insulating liquid 13 increases and the insulating liquid 13 is expanded in the radiation generating apparatus 11 during the driving, a pressure adjustment port (not shown) using an elastic member is formed in a part of the envelope 12 in accordance with necessity.

As an insulating liquid 13, a liquid in which insulation performance is high and a cooling ability is high is desirable. Since a temperature of the target 18 becomes high due to heat generation thereof and its heat is propagated to the insulating liquid 13, a liquid whose alteration due to the heat is small is desirable. For example, an electrically insulating oil, an insulating liquid of a fluorine system, or the like can be used.

The radiation tube 14 is a vacuum container having a cylindrical shape in which both ends of the cylinder are closed and the inside is sealed. The electron source 15 is placed in a body portion of the cylinder. The target 18 is placed at one end of the cylinder in opposition to the electron source 15. An electron emitted from the electron source 15 is irradiated to the target 18. A radiation (X-ray) is generated from the target 18. The generated radiation passes through the target substrate 19 and the first window 27 and is emitted to an outside of the envelope 12. Although the radiation tube 14 in the embodiment has such a construction that one end of the cylinder is closed by an anode 21 constructed by the target 18, target substrate 19, and shielding member 20 and the other end of the cylinder is closed by the cathode portion supporting the electron source 15 and the like, the invention is not limited to such a construction. The shape of the radiation tube 14 may be a quadrangular cylindrical shape or the like. In order to generally keep a vacuum degree of the inside of the radiation tube 14 to a value which is equal to or less than $1\times10^{-4}$ Pa at which the electron source 15 can be driven, a barium getter, NEG, a small ion pump (not shown), or the like for absorbing gases which are emitted from the radiation tube 14 during the driving may be placed in the radiation tube 14. As a material of the body portion of the cylinder of the radiation tube 14, ceramic in which electric insulation performance is high, a high vacuum degree can be maintained, and heat resistance is high is desirable. For example, alumina, glass, or the like can be used. As an electron source 15, a filament, an impregnated cathode, a field emission type device, or the like can be used.

The target 18 is placed on the surface of the target substrate 19 on the electron source side in opposition to the electron source 15. As a material of the target 18, a metal such as tungsten, molybdenum, copper, or the like can be used.

The target substrate 19 is a member supporting the target 18 and is a window for allowing the radiation generated from the target 18 to be transmitted and emitted to the outside of the radiation tube 14. The target substrate 19 is adhered to the cylindrical shielding member by silver-alloy brazing or the like, in which the shielding member 20 has a function for absorbing the radiation which is generated from the target 18 and is irradiated in the unnecessary directions and a function as a thermal diffusion plate of the target substrate 19. A shape of the shielding member 20 may be a cylindrical shape, a quadrangular cylindrical shape, or the like. The electron emitted from the electron source 15 passes through an opening portion of the shielding member 20 on the side near the electron source 15 and is irradiated to the target 18. The radiation is generated from the target 18 and is irradiated in all directions. The radiation which was transmitted through the target substrate 19 passes through an opening portion of the shielding member 20 on the side far from the electron source 15 and, thereafter, is emitted to the outside of the envelope 12 from the first window 27. In FIGS. 1A and 1B, the opening portion of the shielding member 20 on the side far from the electron source 15 is located outwardly of the target substrate 19. Such a structure is more desirable in terms of a point that the unnecessary radiation in the radiation emitted from the target 18 toward the outside thereof can be shielded by the inner wall of the shielding member 20. In the embodiment, since the invention has such a construction that the target substrate 19 is adhered to the cylindrical shielding member 20, the heat generated from the target 18 at the time of generation of the radiation is propagated to the target substrate 19 and the shielding member 20 and, thereafter, is propagated to the insulating liquid 13 and the radiation tube 14. It is not always necessary to provide the target substrate 19. If the target substrate 19 is not provided, the target 18 is adhered to the cylindrical shielding member 20 by silver-alloy brazing or the like and the target 18 becomes a window adapted to emit the radiation to the outside of the radiation tube 14. In this case, the heat generated from the target 18 is propagated to the insulating liquid 13 and the shielding member 20 and, thereafter, is propagated to the radiation tube 14. As a material of the target substrate 19, a material in which a heat conductivity is high and a radiation absorbing ability is low is desirable. For example, SiC, diamond, carbon, thin film oxygen free copper, beryllium, or the like can be used. Hereinbelow, it is assumed that the target substrate 19 is referred to as "second window 19". As a material of the shielding member 20, a material in which a radiation absorbing ability is high is desirable. For example, a metal such as tungsten, molybdenum, oxygen free copper, lead, tantalum, or the like can be used.

A radiation 24 emitted from the second window 19 passes through the inside of the insulating liquid 13 and is emitted to the outside of the envelope 12 from the first window 27 formed in the radiation emitting portion of the envelope 12. The first window 27 faces the second window 19. The solid-state insulating member 28 is placed between the first window 27 and its periphery and the second window and its periphery. It is desirable that the first window 27 and the second window 19 are arranged in such a manner that a center axis of the first window and a center axis of the second window are in the same line. The radiation 24 passes through the insulating member 28 and is emitted to the outside of the envelope 12 from the first window 27. As a material of the first window 27, a material in which a radiation attenuation amount is relatively small such as acryl, polycarbonate, aluminum, or the like is desirable. This is because it is intended to enable the stronger radiation 24 to be emitted from the envelope 12. As a material of the insulating member 28, a material in which electric insulation performance is high is desirable. For example, polyimide, ceramic, epoxy resin, glass, or the like is desirable. It is desirable that the insulating member 28 has a plate shape having a thickness of 0.5 to 6 mm from a viewpoint of assuring the voltage proof performance between the first window 27 and its periphery and the second window 19 and its periphery. In the embodiment, an epoxy plate having a thickness of 3 mm is placed as an insulating member 28. As a material of the insulating member 28, a material in which electric insulation performance is higher than that of the insulating liquid 13 may be used. As a material of the insulating member 28, a material having a radiation transmittance which is equal to or higher than that of the insulating liquid 13 may be used.

The holding member 25 is provided to hold the radiation tube 14. In FIGS. 1A and 1B, the radiation tube 14 is adhered to the body portion of the envelope 12 by the holding member 25 at two positions of the body portion. As a material of the holding member 25, for example, a metal having conductivity such as iron, stainless steel, brass, copper, or the like or a member having insulation performance such as engineering plastics, ceramic, or the like can be used.

The first control electrode 16 is provided to lead out the electron generated from the electron source 15. The second control electrode 17 is provided to control a focus diameter of the electron in the target 18. In the case where the first control electrode 16 and the second control electrode 17 are provided as shown in the embodiment, an electron flux 23 emitted from the electron source 15 by an electric field which is formed by the first control electrode 16 is converged by electric potential control of the second control electrode 17. Since an electric potential of the target 18 is set to a positive potential to the electron source 15, the electron flux 23 which passed through the second control electrode 17 is attracted to the target 18 and collides with the target 18, so that the radiation 24 is generated. ON/OFF of the electron flux 23 is controlled by a voltage of the first control electrode 16. As a material of the first control electrode 16, for example, stainless steel, molybdenum, iron, or the like can be used.

The power supply circuit 26 is connected to the radiation tube 14 (a wiring is not shown) and is provided to supply an electric power to each of the electron source 15, first control electrode 16, second control electrode 17, and target 18. Although the power supply circuit 26 is arranged in the envelope 12 in the embodiment, it may be arranged outside of the envelope 12.

In the case of radiation imaging a human body or the like, an electric potential of the target 18 is higher than that of the electron source 15 by about +30 to 150 kV. Such a potential difference is an acceleration potential difference which is necessary for allowing the radiation which is generated from the target 18 to be transmitted through the human body and to effectively contribute to the radiation imaging. When the radiation imaging of the human body is performed, the X-ray is generally used. However, the invention can be also applied to a radiation other than the X-ray.

The radiation generating apparatus 11 of the embodiment uses a power supply system of a middle point grounding type in which a potential difference V between the target 18 and the electron source 15 is set to 20 to 160 kV, an electric potential of +V/2 is applied to the target 18, an electric potential of −V/2 is applied to the electron source 15, and the apparatus 11 is grounded by the holding member 25. This is because the envelope 12 can be generally miniaturized in consideration of a dielectric breakdown distance of the insulating liquid 13. The embodiment is not limited to the middle point grounding type. However, if the middle point grounding type is used, an absolute value of a voltage of the target 18 to the ground and an absolute value of a voltage of the electron source 15 to the ground can be decreased, so that a scale of the power supply circuit 26 can be reduced as compared with that of an anode grounding type or the like. Therefore, it is more desirable from such a viewpoint. Even if the apparatus is not grounded at the middle point, for example, even in the case where the holding members 25 are placed at positions away from both ends of the radiation tube 14 and the apparatus is grounded at those positions, the power supply circuit 26 can be also reduced as compared with that of the anode grounding type or the like.

When the radiation generating apparatus 11 with the above construction is driven by the potential difference V, an electric potential of each of the target 18, second window 19, and shielding member 20 is equal to +V/2. Since the first window 27 and envelope 12 which face them are equal to a grounding potential, a potential difference of +V/2 occurs between them. Such a potential difference is a very high potential difference of 10 to 80 kV. From a viewpoint of miniaturization of the apparatus, it is better to shorten a distance between the first window and its periphery and the second window 19 and its periphery as much as possible. However, if such a distance is decreased, a discharge is liable to occur. Since there is a possibility that an electric field which is caused by the potential difference of +V/2 is concentrated due to the shapes of the target 18, second window 19, and shielding member 20, a portion near the target 18 becomes a portion in which the discharge is liable to occur. Further, in the radiation tube 14, a heat generation at one end provided with the target 18 is large. That is, since the heat generated in the target 18 is propagated to the second window 19 and the shielding member 20, a heat generation at the anode 21 is large. For example, when the radiation generating apparatus 11 is driven by a power of about 150 W, it is presumed that the highest temperature of the surface of the shielding member 20 is equal to or higher than 200° C. Therefore, in the case of an insulating material in which the voltage proof performance deteriorates due to an influence by the temperature such as an insulating liquid 13, the portion near the target 18 becomes a portion in which the discharge is further liable to occur.

Therefore, in the embodiment, as illustrated in FIGS. 1A and 1B, the solid-state insulating member 28 is placed so as to contact with the first window 27 and the inner wall of its peripheral envelope 12. The insulating member 28 is placed so as to have an interval from the second window 19 and its periphery. Since the solid-state insulating member 28 is used, a withstanding voltage between the first window 27 and its periphery and the second window 19 and its periphery is further improved as compared with that in the case where the insulating member 28 is not used. Generally, although the insulating liquid such as an electrically insulating oil has high insulation performance and high voltage proof performance, there is a case where the voltage proof performance deteriorates due to impurities, moisture, bubbles, and the like which are contained in the insulating liquid or are caused by an aging deterioration. Therefore, by providing the solid-state insulating member 28, the high voltage proof performance can be more certainly maintained. Consequently, even if the distance between between the first window 27 and its periphery and the second window 19 and its periphery is decreased and the apparatus is miniaturized, the withstanding voltage can be assured. Since the distance between between the first window 27 and its periphery and the second window 19 and its periphery can be decreased, the attenuation amount of the radiation can be reduced.

As mentioned above, according to the embodiment, since the foregoing construction is used, the miniaturization of the apparatus, the improvement of the withstanding voltage between the envelope 12 and the radiation tube 14, and a decrease in attenuation amount of the radiation can be realized. Consequently, the radiation generating apparatus with the high reliability which can stably generate the radiation for a long time can be realized.

In FIGS. 1A and 1B, the insulating member 28 is placed so as to cover the first window 27 and the whole inner wall of its peripheral envelope 12 in opposition to the second window 19 and its periphery. Although it is better to arrange the insulating member 28 as mentioned above from a viewpoint of more certainly suppressing the discharge which is caused between the radiation tube 14 and the envelope 12, the invention is not limited to such a layout. If the insulating member 28 is placed in a region in opposition to an edge surface closest to the first window 27 in the anode 21, an advantage of the invention is obtained. In the case where a part of an edge surface of the shielding member 20 is projected to the first window 27 side than the second window 19 as illustrated in FIGS. 1A and 1B, if the insulating member 28 is placed in a region in opposition to an edge surface of the protruding portion of the shielding member 20, an advantage of the invention is obtained. This is because if the anode 21 has the shape as illustrated in FIGS. 1A and 1B, since the edge surface of the protruding portion of the shielding member 20 is closest to the first window 27 and its periphery, the discharge is particularly liable to occur therebetween.

The shape of the anode 21 is not limited to the shape in FIGS. 1A and 1B. It is not always necessary to use such a structure that a part of the edge surface of the shielding member 20 is projected to the first window 27 side than the second window 19 as illustrated in FIGS. 1A and 1B. For example, even in the case where the edge surface of the shielding member 20 and the surface of the second window 19 on the side of the first window 27 are flush surfaces, the invention can be applied.

Second Embodiment

Figure 2:
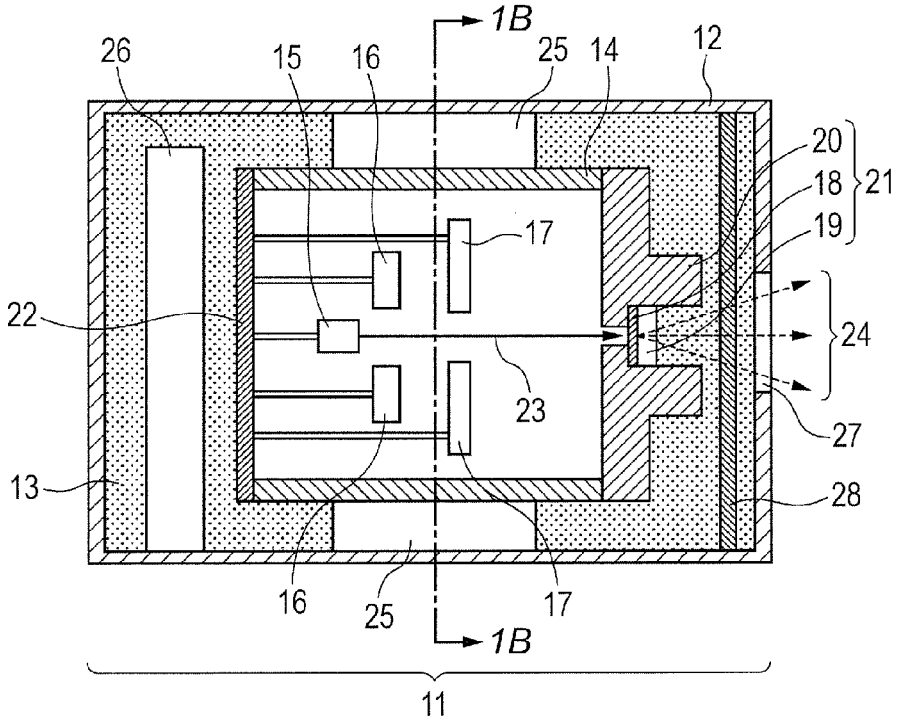
FIG. 2 is a schematic sectional view of a radiation generating apparatus of the second embodiment.

FIG. 2 shows a schematic sectional view of the radiation generating apparatus 11 of the embodiment similar to FIG. 1A. A schematic sectional view of the radiation generating apparatus 11 of the embodiment taken along the line 1B-1B in FIG. 2 is substantially the same as FIG. 1B.

The radiation generating apparatus (transmitting type radiation source) 11 of the embodiment differs from the first embodiment with respect to a point that the insulating member 28 is placed with an interval from the first window 27 and its periphery and with an interval from the second window 19 and its periphery as illustrated in FIG. 2. Since other points are similar to those in the first embodiment, a description of each member other than the insulating member 28 and a description about a construction of the radiation generating apparatus 11 are omitted here.

Since the solid-state insulating member 28 is also placed between the first window 27 and its periphery and the second window 19 and its periphery in the embodiment, the radiation 24 passes through the insulating member 28 and is emitted to the outside of the envelope 12 from the first window 27.

As mentioned above, according to the embodiment, since the foregoing construction is used, an advantage similar to that of the first embodiment is obtained. By placing the insulating member 28 to a position closer to the second window 19 side than that in the first embodiment, the insulating liquid 13 on the first window 27 side than the insulating member 28 is more difficult to be influenced by the temperature or the like as compared with the first embodiment. Therefore, if the distance between the first window 27 and its periphery and the second window 19 and its periphery is set to be identical to that in the first embodiment, the withstanding voltage can be improved more than that in the first embodiment. Further, since the thickness of the layer of the insulating liquid 13 on the first window 27 side than the insulating member 28 can be thinned to such an extent that there will be no problem even if it is subjected to a temperature fluctuation, a smaller size and a lighter weight of the apparatus than those in the first embodiment can be realized.

Although the inside of the envelope 12 is perfectly partitioned to the first window 27 side and the second window 19 side by the insulating member 28 in FIG. 2, the invention is not limited to such a layout. Since the discharge is particularly liable to occur between the edge surface closest to the first window 27 in the anode 21 and the first window 27 and its periphery, it is sufficient that the insulating member 28 is placed in the region in opposition to the edge surface closest to the first window 27 in the anode 21.

Third Embodiment

Figure 3:
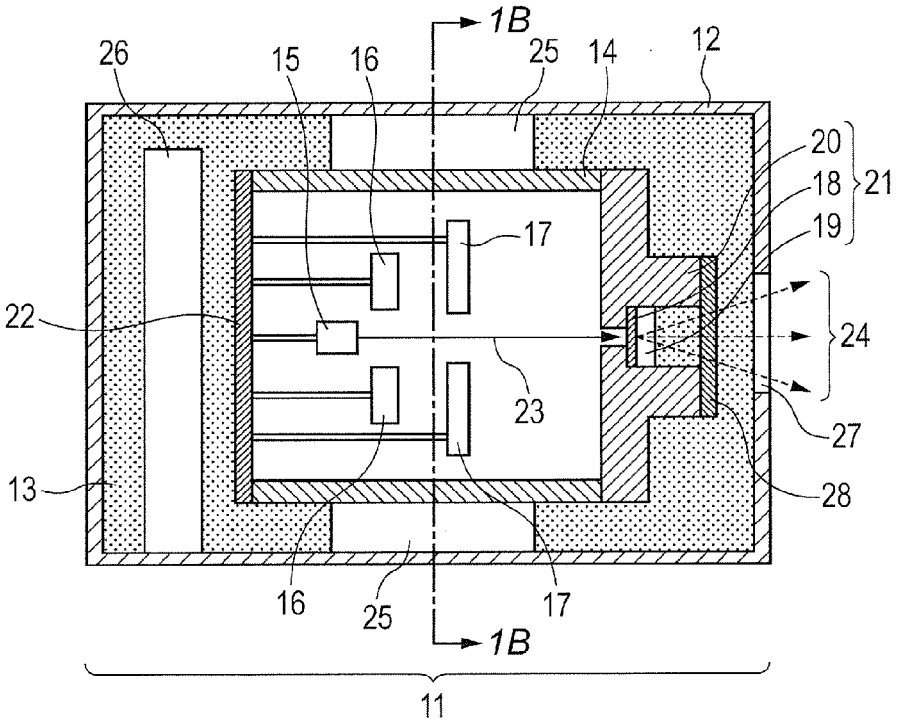
FIG. 3 is a schematic sectional view of a radiation generating apparatus of the third embodiment.

FIG. 3 shows a schematic sectional view of the radiation generating apparatus 11 of the embodiment similar to FIG. 1A. A schematic sectional view of the radiation generating apparatus 11 of the embodiment taken along the line 1B-1B in FIG. 3 is substantially the same as FIG. 1B.

The radiation generating apparatus (transmitting type radiation source) 11 of the embodiment differs from the first and second embodiments with respect to a point that the insulating member 28 is placed so as to contact with the edge surface of the protruding portion of the shielding member 20 and to close the second window 19 and is placed with an interval from the first window 27 and its periphery as illustrated in FIG. 3. Since other points are similar to those in the first and second embodiments, a description of each member other than the insulating member 28 and a description about a construction of the radiation generating apparatus 11 are omitted here.

Also in the embodiment, the solid-state insulating member 28 is placed between the first window 27 and its periphery and the second window 19 and its periphery in the second embodiment, the radiation 24 passes through the insulating member 28 and is emitted to the outside of the envelope 12 from the first window 27.

As mentioned above, according to the embodiment, since the foregoing construction is used, an advantage similar to that of the second embodiment is obtained. By placing the insulating member 28 to a position closer to the second window 19 side than that in the second embodiment, the insulating liquid 13 on the first window 27 side than the insulating member 28 is more difficult to be influenced by the temperature or the like as compared with the second embodiment. Therefore, if the distance between the first window 27 and its periphery and the second window 19 and its periphery is set to be identical to that in the second embodiment, the withstanding voltage can be improved more than that in the second embodiment. Further, since the thickness of the layer of the insulating liquid 13 on the first window 27 side than the insulating member 28 can be set to a thickness thinner than the thickness set in the second embodiment in such a manner that there will be no problem even if it is subjected to the temperature fluctuation, a smaller size and a lighter weight of the apparatus than those in the second embodiment can be realized.

Fourth Embodiment

Figure 4:
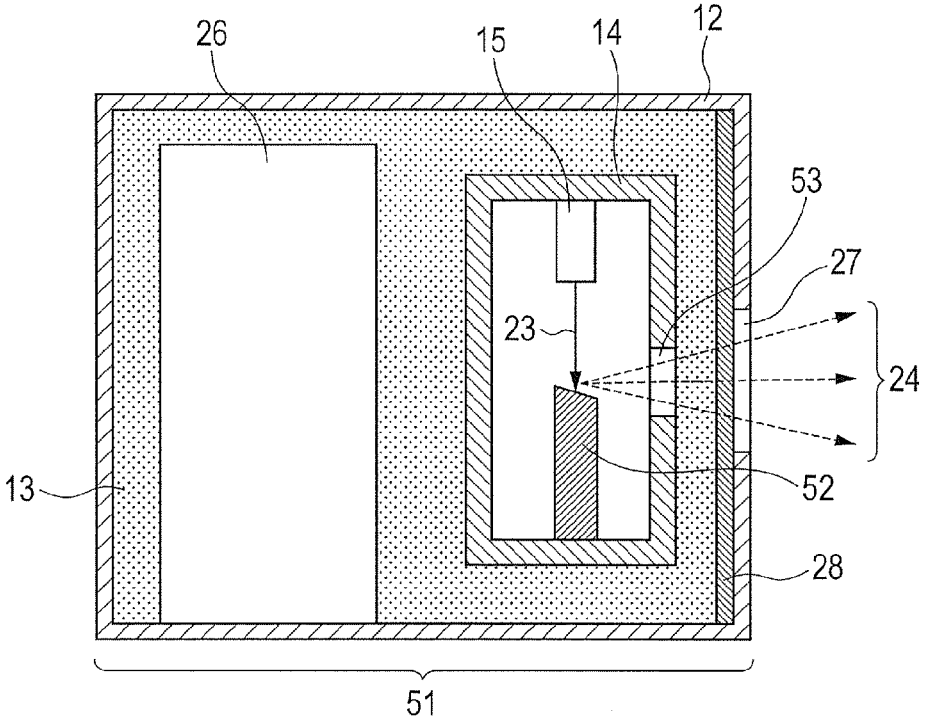
FIG. 4 is a schematic sectional view of a radiation generating apparatus of the fourth embodiment.

FIG. 4 shows a schematic sectional view of a radiation generating apparatus 51 of the embodiment.

The radiation generating apparatus (reflection type radiation source) 51 of the embodiment differs from the first to third embodiments with respect to a point that the reflection type radiation tube 14 is used. Since other points are similar to those in the first embodiment, a description of each member other than a reflection type target 52, a second window 53, and the radiation tube 14 is omitted here.

The radiation generating apparatus 51 of the embodiment has the envelope 12, insulating liquid 13, radiation tube 14, electron source 15, power supply circuit 26, first window 27, insulating member 28, reflection type target 52, and second window 53.

The reflection type target 52 is placed in opposition to the second window 53 so as to have an interval from the second window 53. The radiation tube 14 is such a vacuum container that the electron flux 23 emitted from the electron source 15 is made to collide with the reflection type target 52, thereby generating the radiation 24. After the radiation 24 passed through the second window 53 as a part of the radiation tube 14, it is emitted to the outside of the envelope 12 from the first window 27.

Also in the embodiment, the solid-state insulating member 28 is placed between the first window 27 and its periphery and the second window 53 and its periphery, the radiation 24 passes through the insulating member 28 and is emitted to the outside of the envelope 12 from the first window 27.

As mentioned above, according to the embodiment, since the foregoing construction is used, an advantage similar to that of the first embodiment is obtained.

Although the insulating member 28 is placed so as to cover the first window 27 and the whole inner wall of the envelope 12 of the periphery of the first window 27 in opposition to the second window 53 and its periphery in FIG. 4, the invention is not limited to such a layout. It is sufficient that the insulating member 28 is placed in the region in opposition to the edge surface closest to the first window 27 in the radiation tube 14.

The insulating member 28 may be placed with an interval from the first window 27 and its periphery and with an interval from the second window 53 and its periphery or may be placed so as to contact with the second window 53 and its periphery and so as to have an interval from the first window 27 and its periphery.

Fifth Embodiment

Figure 5:
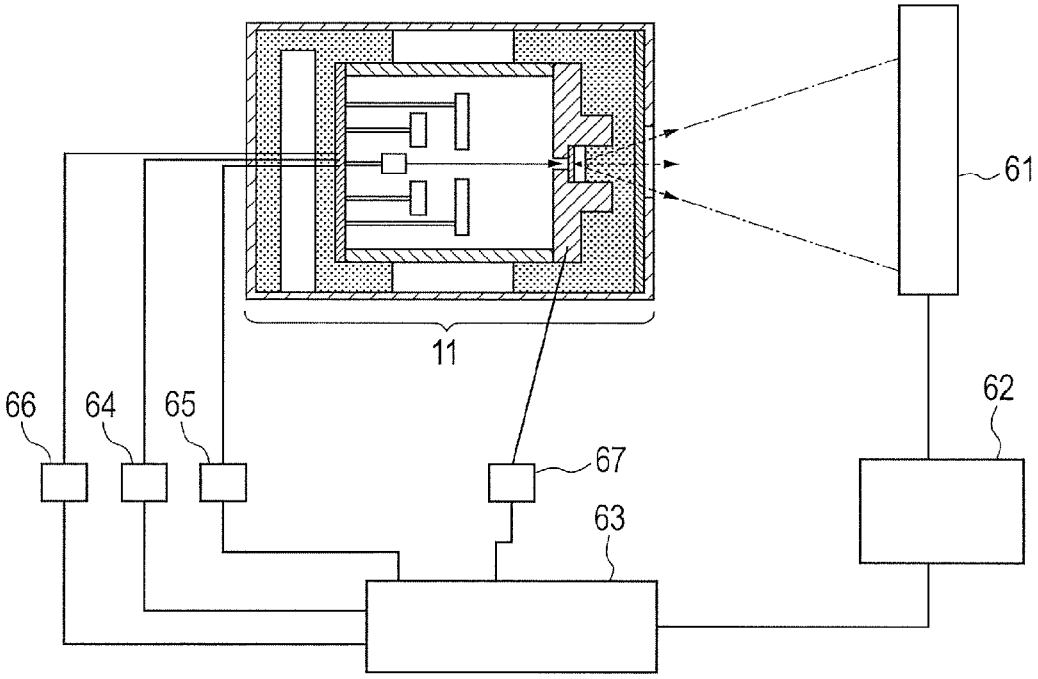
FIG. 5 is a constructional diagram of a radiation imaging apparatus using the radiation generating apparatus of the invention.

A radiation imaging apparatus using the radiation generating apparatus of the invention will be described with reference to FIG. 5. FIG. 5 is a constructional diagram of the radiation imaging apparatus of the embodiment. The radiation imaging apparatus has the radiation generating apparatus 11, a radiation detector 61, a radiation detection signal processing unit 62, a radiation imaging apparatus control unit 63, an electron source driving unit 64, an electron source heater control unit 65, a control electrode voltage control unit 66, and a target voltage control unit 67. For example, the radiation generating apparatus of each of the first to fourth embodiments is desirably used as a radiation generating apparatus 11.

The radiation detector 61 is connected to the radiation imaging apparatus control unit 63 through the radiation detection signal processing unit 62. An output signal of the radiation imaging apparatus control unit 63 is connected to each terminal of the radiation generating apparatus 11 through the electron source driving unit 64, electron source heater control unit 65, control electrode voltage control unit 66, and target voltage control unit 67.

When the radiation is generated by the radiation generating apparatus 11, the radiation emitted into the atmosphere passes through an inspection object (not shown), is detected by the radiation detector 61 and a radiation transmitting image of the inspection object is obtained. The obtained radiation transmitting image can be displayed to a display unit (not shown).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-152791, filed Jul. 11, 2011, which is hereby incorporated by reference herein in its entirety.

What is claimed is:

1. A radiation generating apparatus comprising:

an envelope having a first window for transmitting radiation;

a transmitting-type radiation tube held within said envelope, and having a transmitting-type target, a second window supporting said transmitting-type target and a tubular anode member holding said second window, with a space defined between said transmitting-type radiation tube and said envelope;

an insulating liquid filling said space between said envelope and said transmitting-type radiation tube so as to be present between said first window and said second window;

a power source unit electrically connected to said transmitting-type radiation tube in middle-point grounding manner; and a solid-state insulating member located between said first window and said second window, wherein said second window is caused to be at a higher potential by said power source than is said first window, and said solid-state insulating member is spaced apart from said transmitting-type target and said tubular anode member.

2. The radiation generating apparatus according to claim 1, wherein said solid-state insulating member is arranged in contact with said first window, and in contact with a periphery of said first window.

3. The radiation generating apparatus according to claim 1, wherein said solid-state insulating member is formed in a plate shape having a thickness of 0.5 to 6 mm.

4. The radiation generating apparatus according to claim 1, wherein said solid-state insulating member is formed from one or more of the group consisting of polyimide, ceramics, epoxy resin and glass.

5. The radiation generating apparatus according to claim 1, wherein said insulating liquid comprises an electrically insulating oil.

6. The radiation generating apparatus according to claim 1, wherein said solid-state insulating member has a stronger electrical insulation property than that of said insulating liquid.

7. The radiation generating apparatus according to claim 1, wherein said solid-state insulating member has radiation transmittance equal to or higher than that of said insulating liquid.

8. The radiation generating apparatus according to claim 1, further comprising a holding member by means of which said transmitting-type radiation tube is secured to said envelope, said holding member holding a body portion of said transmitting-type radiation tube.

9. The radiation generating apparatus according to claim 8, wherein said holding member includes an insulator.

10. The radiation generating apparatus according to claim 1, wherein said power source unit is arranged within said envelope.

11. The radiation generating apparatus according to claim 1, wherein said first window and said second window are arranged in a coaxial manner.

12. The radiation generating apparatus according to claim 1, wherein said transmitting-type radiation tube has a cylindrical body portion formed from a ceramic.

13. A radiation imaging apparatus comprising:

a radiation generating apparatus according to claim 1;

a radiation detecting apparatus for detecting radiation emitted from said radiation generating apparatus and passing through an object; and a controlling unit for controlling said radiation generating apparatus and said radiation detecting apparatus.

14. The radiation generating apparatus according to claim 1, wherein said transmitting type radiation tube includes an electron source, and said transmitting type target has a layer on said second window at an electron-source side.

15. The radiation generating apparatus according to claim 1, wherein said second window is an end window of said transmitting-type radiation tube.

16. The radiation generating apparatus according to claim 1, wherein said insulating member is spaced apart from said first window.

17. The radiation generating apparatus according to claim 16, wherein said insulating member is further away from said second window than from said first window.

18. A radiation generating apparatus comprising:

an envelope having a first window for transmitting radiation;

a transmitting-type radiation tube held within said envelope, and having an anode comprising a transmitting-type target, a second window supporting said transmitting-type target and a tubular anode member holding said second window, with a space defined between said envelope and said transmitting-type radiation tube;

an insulating liquid filling said space between said envelope and said transmitting-type radiation tube so as to be located between said first window and said second window, wherein a potential of said second window is higher than that of said first window; and a solid-state insulating member located between said first window and said second window, wherein said solid-state insulating member is spaced apart from said anode.

19. The radiation generating apparatus according to claim 18, further comprising:

a power source unit electrically connected to said transmitting-type radiation tube.

20. The radiation generating apparatus according to claim 19, wherein said power source unit is electrically connected to said transmitting-type radiation tube in middle point grounding manner.

21. The radiation generating apparatus according to claim 18, wherein said envelope is at ground potential.

22. The radiation generating apparatus according to claim 18, wherein said first window is made from aluminum.

23. The radiation generating apparatus according to claim 18, wherein said insulating member is spaced apart from said first window.

24. The radiation generating apparatus according to claim 23, wherein said insulating member is further away from said second window than from said first window.

* * * * *